US010994437B2

(12) United States Patent
Schroder

(10) Patent No.: US 10,994,437 B2
(45) Date of Patent: May 4, 2021

(54) HARDENED STEEL COUNTER-DIE

(71) Applicant: Michigan Lasercut, Kentwood, MI (US)

(72) Inventor: Steven W. Schroder, Grand Rapids, MI (US)

(73) Assignee: Michigan Lasercut, Kentwood, MI (US)

( * ) Notice: Subject to any disclaimer, the term of this patent is extended or adjusted under 35 U.S.C. 154(b) by 829 days.

(21) Appl. No.: 14/983,821

(22) Filed: Dec. 30, 2015

(65) Prior Publication Data

US 2016/0185005 A1 Jun. 30, 2016

Related U.S. Application Data

(60) Provisional application No. 62/098,674, filed on Dec. 31, 2014.

(51) Int. Cl.
*B26F 1/44* (2006.01)

(52) U.S. Cl.
CPC ..... *B26F 1/44* (2013.01); *B26F 2001/4445* (2013.01); *B26F 2001/4463* (2013.01)

(58) Field of Classification Search
CPC ..... B26F 1/44; B26F 2001/4445; B26F 2001/4463; B26F 2001/4436; B26F 2001/4481; B23P 15/24; B21D 37/08; B31B 50/252; C21D 1/06
USPC ..... 76/107.1, 107.4, 107.6, 107.8; 148/902
See application file for complete search history.

(56) References Cited

U.S. PATENT DOCUMENTS 3,052,139 A * 9/1962 Trimble ..... B21D 37/205 29/509
3,152,492 A * 10/1964 Whitecotton ..... B21D 37/205 76/107.8
3,847,036 A * 11/1974 Miller ..... B21D 28/14 76/107.8
3,929,059 A * 12/1975 Gendron ..... B26F 1/44 493/354
4,249,432 A * 2/1981 Graboyes ..... B23P 15/406 76/107.8
4,289,055 A * 9/1981 Von Schriltz ..... B26D 7/20 83/347
4,431,466 A * 2/1984 MeLampy ..... C21D 1/06 148/641
4,533,391 A 8/1985 Borneman et al.
5,140,872 A * 8/1992 Holliday ..... B26F 1/44 219/121.67
5,211,084 A 5/1993 Holliday et al.
5,333,519 A * 8/1994 Holliday ..... B26F 1/44 219/121.67

(Continued)

FOREIGN PATENT DOCUMENTS

DE 9304571 U1 5/1993
EP 0780199 A1 6/1997

*Primary Examiner* — Thomas M Wittenschlaeger
(74) *Attorney, Agent, or Firm* — Price Heneveld LLP

(57) ABSTRACT

A counter-die includes a body portion comprised of a relatively soft plate material that is substantially planar for use in a die converting process. The counter-die is comprised of a metallic material that includes a bearing surface that is work-hardened over time in a repeated die converting process to provide a work-hardened outer layer that exhibits a medium-hard to hard characteristic as compared to the body portion of the counter-die.

20 Claims, 7 Drawing Sheets

(56) References Cited

U.S. PATENT DOCUMENTS

| | | | | | |
|---|---|---|---|---|---|
| 5,566,594 | A * | 10/1996 | Michlin | B23P 15/24 | 76/107.8 |
| 5,761,982 | A * | 6/1998 | Abt | B26D 7/20 | 83/861 |
| 5,943,935 | A * | 8/1999 | Brayton | B26F 1/44 | 493/354 |
| 6,085,625 | A * | 7/2000 | Sandford | B26F 1/44 | 76/107.8 |
| 6,189,414 | B1 * | 2/2001 | Yoshizawa | B23P 15/406 | 76/107.8 |
| 2011/0252933 | A1 * | 10/2011 | Talkington | B26D 3/08 | 83/13 |
| 2014/0013915 | A1 * | 1/2014 | Kodama | B26F 1/44 | 83/651 |

* cited by examiner

HARDENED STEEL COUNTER-DIE

CROSS REFERENCE TO RELATED APPLICATION

This present application claims the benefit of U.S. Provisional Application No. 62/098,674 entitled "HARDENED STEEL COUNTER DIE" filed on Dec. 31, 2014, the entire contents of which are incorporated by reference.

FIELD OF THE INVENTION

The present invention generally relates to a counter-die assembly, and more particularly, to a counter-die assembly that is easily milled, substantially planar and configured to harden over time in a repeated die converting process.

BACKGROUND OF THE INVENTION

In the die converting or die cutting industry, die cutting machines are used to stamp sheets of material according to a predefined pattern to create a blank. Generally, a cutting die and a counter-die cooperate to cut and crease a sheet of a substrate to provide a blank. The cutting die, or upper die, typically includes cutting blades and rulings which protrude from a supporting plate. The supporting plate is generally made of wood, plywood or synthetic materials layered in a specific arrangement about a core. The blades and rulings are arranged according to a predefined pattern and generally extend outwardly from the supporting plate towards a substrate which is positioned on the counter-die, sometimes referred to as the lower die, female die or cutting plate, in the die converting apparatus. The counter-die must also be prepared for a die converting procedure and will generally be comprised of a hardened steel plate. Many processes used to harden a steel plate for use as a counter-die can cause distortion in the counter-die, such that the resulting counter-die may be crinkled or out of the specifications of a particular job. A substantially planar or "distortion-free"/"crinkle-free" plate is desired for use in preparing a counter-die, to ensure that the paperboard substrate is cut consistently in a repeated die converting process. Once a counter-die has been hardened, not only may the resulting plate be distorted, it is also more difficult to mill channels in the counter-die that correlate to a predefined cutting pattern of the mating cutting die.

In the past, plates exhibiting a hardness of approximately 32-52 on the Rockwell C Scale were preferred for use as a counter-die in a die converting process, due to their performance as compared to counter-dies made from softer plate materials. Such hardened plates are often non-planar, distorted or generally out of specification due to the intense hardening process used to achieve the hardness value of 32-52 on the Rockwell C Scale. Martensitic transformation, more commonly known as quenching and tempering, is commonly used to harden steel plates for use as counter-dies. Tempering involves exposing the steel plates to elevated heat levels by heating the metal to some temperature below the critical point for a certain period of time, then allowing it to cool in still air. This process can lead to plate distortion which may make the resulting plate unsuitable for a given die converting task as steel plates generally exhibit an inverse relationship between hardness and flatness. Further, such plates can be brittle and difficult to mill when trying to mill a cutting pattern into the hardened counter-die.

Further, the cost of the plate material used in making a counter-die is a concern. Plates that have been heat treated, or otherwise hardened, to be in the hard to medium-hard range on the Rockwell C Scale can be up to 5 times more expensive than a soft plate material that has not been treated for hardening.

The plate materials currently available for making counter-dies will not change properties significantly with use from their original state. Thus, it is desirable to provide a plate material that begins in the soft range of the Rockwell C Scale to ensure that cost savings are realized, flatness is achieved and repeated use of the counter-die results in a plate that started in the soft range of the Rockwell C Scale, but has been work-hardened to a long running, wear resistant plate that will last for millions of impressions when used properly in a die converting process. It is further desirable to provide a steel plate material that is substantially planar and not processed for hardening to prepare an exact counter-die for a specific job that still provides the hardness levels necessary for repeated impressions in a die converting process.

BRIEF SUMMARY OF THE INVENTION

One aspect of the present invention includes a counter-die configured for use with a cutting die in a die press. The counter-die includes a metal plate having a body portion with a first material thickness and a first Rockwell Scale hardness value. A lower mounting surface is disposed on an underside of the body portion and configured to be received on a lower platen of the die press. A work-hardened bearing surface is disposed on an opposite side of the body portion relative to the lower mounting surface and is formed after repeated impressions realized on the counter-die by the cutting die in a die converting process. The work-hardened bearing surface includes a second Rockwell Scale hardness value that is greater than the first Rockwell Scale hardness value of the body portion of the metal plate.

Another aspect of the present invention includes a method of making a counter-die comprising the steps of: forming a plate with a body portion and an upper bearing surface from a soft plate material; registering the plate on a lower platen of a die press; registering a corresponding male die on an upper platen of the die press; and work-hardening the bearing surface in a die converting process, wherein the male die makes an impression on the plate, to form a counter-die with a work-hardened outer layer.

Yet another aspect of the present invention includes a counter-die configured for use with a cutting die in a die press. The counter-die includes a metal plate having a first material thickness and a first Rockwell Scale hardness value. A work-hardened bearing surface is formed after repeated impressions realized on the counter-die by the cutting die in a die converting process. The work-hardened bearing surface includes a second Rockwell Scale hardness value that is greater than the first Rockwell Scale hardness value of the body portion of the metal plate.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
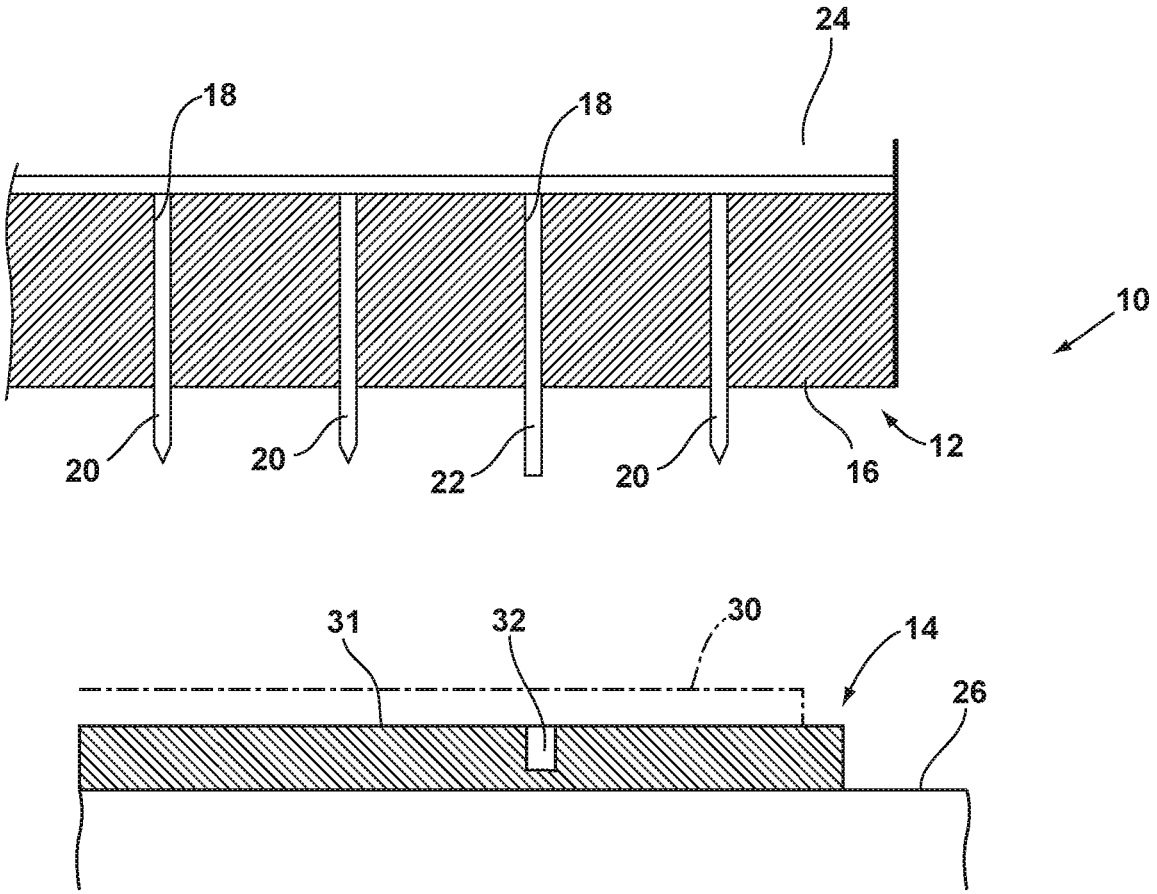
FIG. 1 (PRIOR ART)
FIG. 1 is a fragmentary cross-sectional view of a die press having a cutting die and a counter-die for cutting a blank as found in the prior art.

For the purposes of description herein, the terms "upper," "lower," "right," "left," "rear," "front," "vertical," "horizontal," "top," "bottom" and derivates thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification, are simply exemplary embodiments. Hence, specific dimensions and other physical characteristics relating to the embodiments disclosed herein are not to be construed as limiting, unless expressly stated otherwise. Further, it is noted that the die converting process is a suitable process for a variety of substrates including, but not limited to, solid bleached sulfate (SBS), solid unbleached sulfate (SUS), clay coated news back, Mylar, polyethylene terephthalate (PET), amorphous polyethylene terephthalate (APET), polyvinyl chloride (PVC), and plastic. Several of these materials may be comprised of virgin or recycled materials. For purposes of the present disclosure, the term "paperboard" will be used throughout as the exemplary substrate used with the present invention.

Referring now to FIG. 1, a cross section of a cutting die apparatus of the prior art is shown. The die cutting apparatus, or die press, 10 includes a cutting die 12 and a counter-die 14. The cutting die 12 includes a base plate 16 which may be a plywood base plate, wherein the base plate 16 includes one or more channels 18 disposed therein. The channels 18 are adapted to receive cutting blades 20 or rulings 22, wherein the cutting blades 20 are adapted to cut a paperboard substrate 30. The rulings 22 are adapted to crease the paperboard substrate 30, as the paperboard substrate 30 is disposed on and supported by the counter-die 14. The cutting die 12 is formed, such that the blades 20 and rulings 22 are fixed in place on the base plate 16. In this way, the cutting die 12 is adapted to cut blanks from the paperboard substrate 30 in a repeatable manner. In assembly, the cutting die 12 is supported in the die cutting apparatus 10 on an upper platen 24.

As further shown in FIG. 1, the counter-die 14 is supported on a lower platen 26. The counter-die 14 includes a cutting surface 31 and one or more channels 32 disposed therein, wherein the channels 32 align and correspond to the rulings 22 disposed on the cutting die 12. In use, the blades 20 will cut through the paperboard 30 as the upper platen 24 is configured to move vertically to bring the blades 20 into contact with the cutting surface 31 of the counter-die 14, such that the paperboard substrate 30 is cut without damaging the blades 20. Conversely, the rulings 22 will crease the paperboard substrate 30 in the die converting process.

Figure 2:
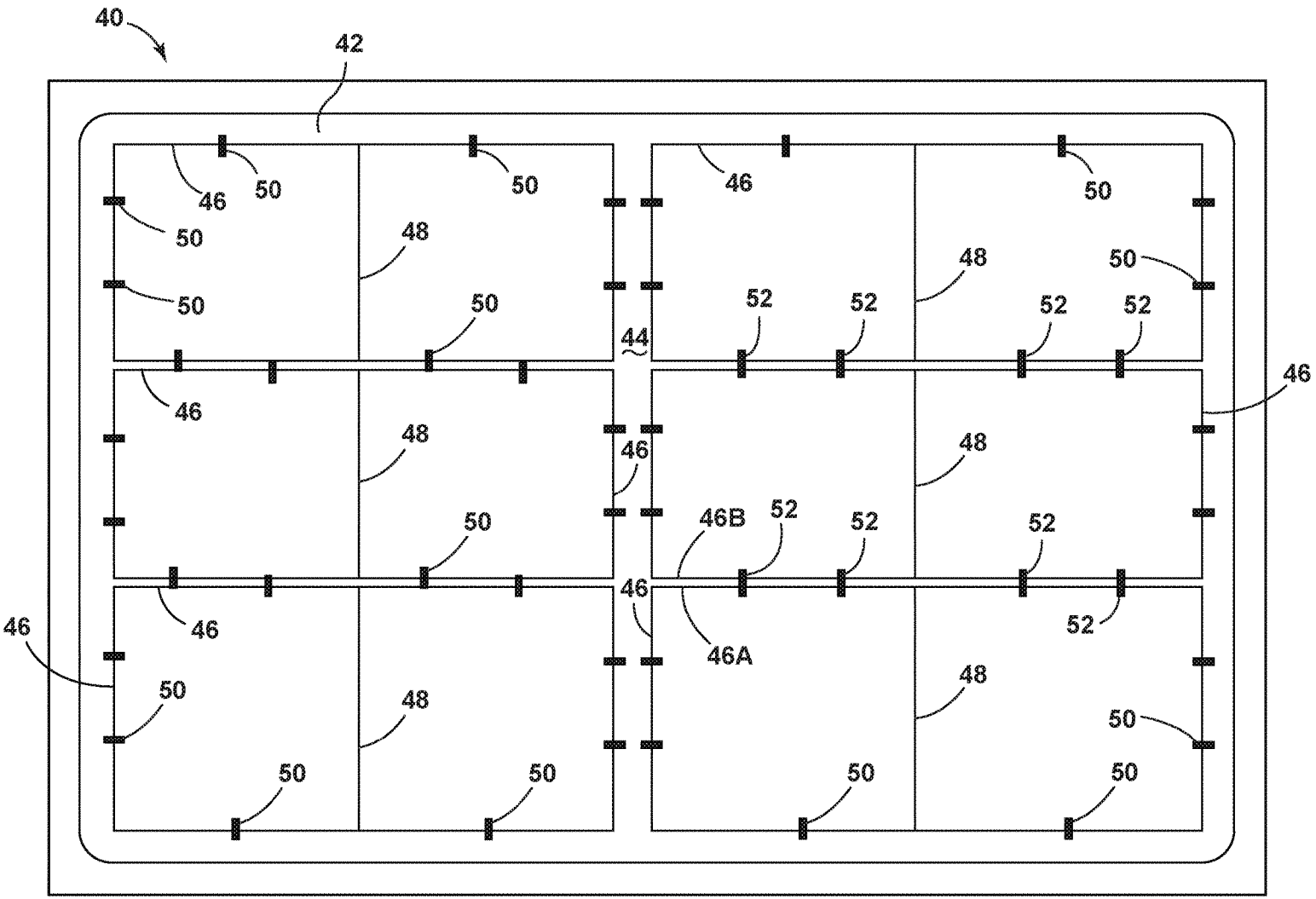
FIG. 2 is a top plan view of a counter-die of the present invention disposed and supported on a lower platen.

Referring now to FIG. 2, a lower platen 40 is shown having a counter-die 42 of the present invention positioned and supported thereon. The counter-die 42 is contemplated to be made from a metallic material, such as stainless steel, and is in the form of a plate or thin plate. The counter-die 42 of the present invention is contemplated to exhibit a material hardness of approximately 18-20 on the Rockwell C Scale (HRC), which is generally considered a soft plate material, as further described below. The counter-die 42 can be made to have any material thickness necessary for a particular job, as best described below with reference to FIGS. 3A and 3B.

Figure 3A:
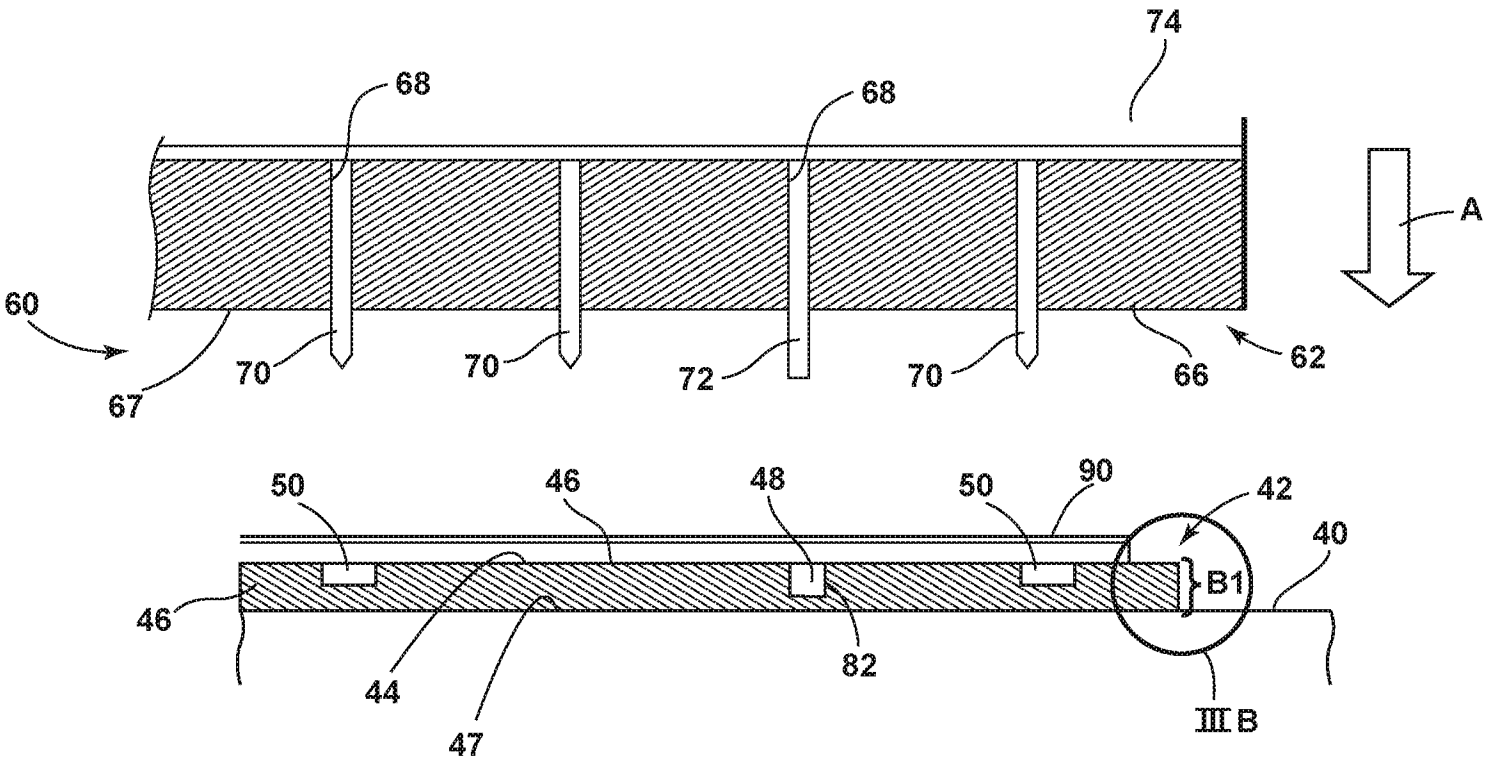
FIG. 3A is a fragmentary cross-sectional view of a die press having a cutting die and a counter-die of the present invention, showing relative movement of the cutting die in a die converting process.

With further reference to FIG. 2, a bearing surface 44 is defined on the exposed face of the counter-die 42 and is configured to receive a paperboard substrate for converting. In use, and as shown in FIG. 3A, the counter-die 42 of FIG. 2 is configured to be positioned below a cutting die in a die press, wherein the cutting die is adapted to cut six card blanks with a crease formed therein as an exemplary cutting pattern indicated by reference numeral 45. As used with the counter-die 42 shown in FIG. 2, the cutting die will include a series of blades adapted to cut a paper substrate along cutting lines 46 disposed on the bearing surface 44 of the counter-die 42 which make up the cutting pattern 45. The cutting die will also include rulings which are adapted to crease the blanks produced from the paperboard along creasing grooves 48 shown in FIG. 2. The creasing grooves 48 may be milled into the counter-die 42, which is comparably easier when done on the counter-die of the present invention given the hardness value of 18-20 HRC, as compared to other plates having greater hardness values.

As further shown in FIG. 2, a plurality of recesses 50 are milled along the cutting lines 46 at various locations and are, in this embodiment, substantially perpendicular to the associated cutting lines 46. The recesses 50 extend into a material thickness of the generally planar body of the counter-die 42 to create a void or relief in the bearing surface 44 of the counter-die 42. The recesses 50 are generally perpendicular to the cutting lines 46, and thereby provide a void necessary to keep a paperboard sheet together during the die converting process. The recesses 50 are created on the bearing surface 44 of the counter-die 42 by a recess forming process such as milling. A micro-milling cutter used on a computer numeric control (CNC) machine can directly form the recesses 50 in the counter-die 42. The depth of the recesses 50 will generally correspond to the paperboard material being converted in the die converting process. Generally, the recesses 50 will have a depth that is slightly greater than the thickness of the paperboard being cut. For example, when using an SBS substrate that is 0.014 inches thick, the corresponding recesses 50 disposed below the SBS material could be 0.016 inches. The milling process can be coordinated with a CAD program adapted to design the cutting die for any particular job. In this way, the milling of the recesses 50 can be computer aided to ensure precision placement along a cutting line, such as cutting lines 46. As further shown in FIG. 2, recesses 52 are positioned on adjacent cutting lines 46A and 46B, such that the recesses 52 create a void in both cutting lines 46A and 46B, thereby keeping the blanks coupled to the scrap or waste paperboard during the die converting process as further described below. With the counter-die 42 of the present invention exhibiting an initial hardness of approximately 18-20 HRC, the counter-die 42 is easily milled to create the milled pattern 45 defined by cutting lines and creasing grooves. This level of hardness would generally be considered "too soft" for use in a die-converting process. This is because such a "soft" plate would generally be susceptible to deformation at the recesses 50 formed in the counter-die 42 as repeated impacts from a cutting die are realized on the counter-die 42 in a die converting process. For purposes of this disclosure, the following scale shown in Table 1 will be used for describing metal substrates of various hardness levels.

TABLE 1

| Plate Type | Hardness on Rockwell C Scale |
|---|---|
| Soft Plate | 18-20 |
| Medium-Hard Plate | 32-38 |
| Hard Plate | 42-52 |

As described above, hard plates and medium-hard plates are much more expensive than a comparably sized soft plate. Hard plates can be up to 5 times the cost of a comparably sized soft plate, while medium-hard plates can cost upwards of 15-20% more than a comparably sized soft plate. The soft plate material used for the present invention provides the initial cost savings as compared to hard or medium-hard plates received from the mill. The soft plate material used for making counter-dies of the present invention are also configured to work-harden over time, as further described below. Thus, the counter-dies of the present invention provide an economic advantage over hard or medium-hard plates received from the mill, and will also work-harden over time to achieve hardness levels in the hard to medium-hard or hard plate range, as further described below. Commonly used materials for forming counter-dies will not work-harden over time, but rather generally retain the physical properties inherent to such counter-dies as received from the mill.

Referring now to FIG. 3A, a die cutting apparatus, or die press, 60 is shown having a cutting die 62 as used with the counter-die apparatus 42. The cutting die 62 includes a base plate 66 with an outer surface 67 having a plurality of channels 68 disposed therein. In assembly, the base plate 66 is adapted to have cutting blades 70 and rulings 72 disposed in the channels 68 for fixedly mounting the blades 70 and crease rulings 72 to the cutting die 62. The cutting die 62 is mounted on or registered on an upper platen 74 in the die cutting apparatus 60, such that the blades 70 and crease rulings 72 extend outwardly and downwardly from the cutting die 62 towards a lower platen 40 to define a cutting pattern 73. As further shown in FIG. 3A, the counter-die 42 is mounted on or registered on the lower platen 40, and includes creasing 82 similar to creasing grooves 48 shown in FIG. 2 which are milled into the bearing surface 44 of the counter-die 42. Recesses 50 are also shown disposed on the bearing surface 44 of the counter-die 42. Cutting lines 46 are adapted to align with the blades 70 of the cutting die 62, and, in the embodiment shown in FIG. 3A, recesses 50 are also adapted to align with blades 70 for creating a bonded portion or nick in the paperboard substrate 90. The blades 70 and crease rulings 72 of the cutting die 62 define a cutting pattern 73 that contact the paperboard substrate 90 as the cutting die 62 moves downward in a die converting process as indicated by arrow A, such that the upper and lower platens 74, 40 cooperate to convert the paperboard substrate 90 in the die cutting apparatus 60. The cutting pattern 73 of the cutting die 62 aligns with the milled pattern 45 of the counter-die 42 when the counter-die 42 and cutting die 62 are properly registered on the die press 60.

As further shown in FIG. 3A, the counter-die 42 includes a substantially planar body portion 43 which includes a lower mounting surface 47 for mounting against lower platen 40, and the working surface or bearing surface 44 disposed opposite the mounting surface 47. The counter-die 42 of the present invention is considered to be a "thin plate", wherein the body portion 43 generally includes a substantially uniform material thickness B1 of about 0.75 mm to about 2.1 mm, or more commonly from about 1.0 mm to about 1.15 mm. In use, the cutting die 62 approaches the counter-die 42 until the cutting blades 70 and rulings 72 have acted on the paperboard substrate 90. The cutting blades 70 and rulings 72 will also impact the bearing surface 44 of the counter-die 42. As impacts, or impressions, are realized on the counter-die 42 by the cutting die 62, the bearing surface 44 of the counter-die 42 will itself compact to form a work-hardened outer layer 49 shown in FIG. 3B. This compaction will affect the material thickness B1 of the counter-die 42 by decreasing the overall material thickness B1 by about 0.0127 mm to 0.0381 mm. The hardened outer layer 49 shown in FIG. 3B may exhibit a material hardness of approximately 36-50 HRC after 10,000-20,000 impressions have been made on the counter-die 42, which, as explained above, is an acceptable hardness for use in a repeated die-converting process.

As noted above, the counter-die 42 is comprised of a metallic material, such as stainless steel. While tempered 301 stainless steel, tempered 304 stainless steel, or annealed 403 stainless steel are customary plate materials for use in forming a counter-die in the die converting industry, these known steel plates, being hardened, may be distorted and out of specification due to a tempering process. In accordance with the present invention, a non-tempered stainless steel, such as 201 stainless steel, is desired for use as a counter-die, as this material is "soft" (having a material hardness of approximately 20 HRC from the mill), and is also substantially planar as compared to other tempered, or otherwise hardened steels, such as tempered 301 or 304 stainless steel considered to be a medium-hard plate (having a material hardness of approximately 32-38 HRC from the mill). For a soft and substantially planar plate material, 201 stainless steel is referenced herein as an exemplary plate material for use in forming a counter-die, but this exemplary material is not meant to limit the scope of the present invention. The 201 stainless steel may also be treated in an annealing process to soften the plate material. Thus, annealed 201 stainless steel is also suitable for use with the present invention.

For purposes of this disclosure, the term "out of specification" refers to a counter-die which has been distorted by a heat treating process, or other like hardening process, such that the plate material is distorted and not substantially planar. Being out of specification may include distortion levels of about 0.5 mm to about 1.5 mm. The distortion factor is also varied upon where the distortion occurs. In treating steel plates, distortion may occur as an edge-to-edge length differential known as an edge wave, a center buckle, or an "oil can" distortion. An edge wave distortion occurs when the edges of the thin plate are longer than the center of the thin plate. This deformation is exhibited in the form of a wave formed along the edges of the plate. If the center of the plate is longer than the edges of the plate, a center buckle is formed, which is sometimes called an "oil can" or "canoe" distortion. With location of a distortion being a concern, it can be said that about a 0.5 mm distortion is a distortion that may render a plate unusable as a counter-die in a given location. Specifically, a 0.7 mm center buckle is generally considered unworkable, but a 1.5 mm edge wave may be workable. When in a specific location and to a certain degree of distortion, a given distortion may make for a counter-die that simply will not run in repeated impressions of a die converting process. A distorted plate is susceptible to movement in a die converting process, especially in a die converting process wherein 5000 to 12,000 impressions occur per hour. Movement in the counter-die increases the "make ready" or setup time for a die operator and leads to costly down time between operations.

The counter-die of the present invention is made from a steel plate that is configured to work-harden in a die converting process, such as 201 stainless steel, that further exhibits an initial hardness level of approximately 18-20 HRC. A 201 stainless steel plate is considered a soft plate at 18-20 HRC, is less expensive than a medium-hard or hard plate, and generally has no appreciable distortion as received from a mill. Using the 201 stainless steel, it has been surprisingly found that the outer layer, such as the bearing layer 44 (FIG. 3A), work-hardens to a level that is well accepted for repeated use in a die converting process to form a hardened outer layer 49 shown in FIG. 3B, as further described below.

Figure 3B:
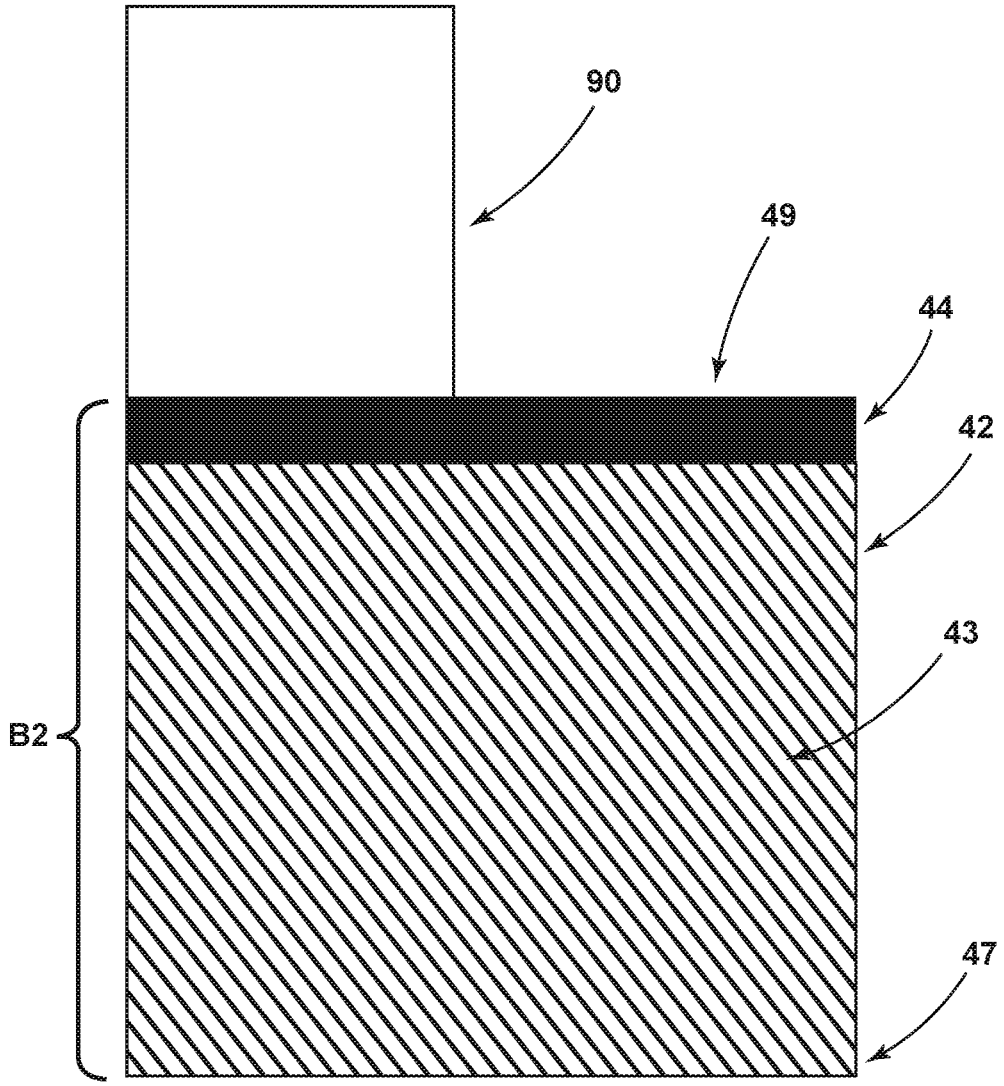
FIG. 3B is a fragmentary cross-sectional view of the counter-die of FIG. 3A taken at location IIIB.

Referring now to FIG. 3B, the counter-die 42 has a material thickness B2, which is less than the material thickness B1 shown in FIG. 3A. This is due to the work-hardening of bearing surface 44 (FIG. 3A) into hardened outer layer 49 (FIG. 3B) which results in a compaction of the counter-die 42. As noted above, this compaction may be from about 0.0127 mm to 0.0381 mm when comparing material thickness B1 (FIG. 3A) to material thickness B2 (FIG. 3B). The hardened outer layer 49 provides a hardened surface which is suitable for multiple impressions in a die converting process. Thus, the counter-die 42 provides a low cost plate material (as compared to medium-hard or hard plate materials) that is substantially planar or free from distortions (as compared to heat treated or hardened plate materials), as well as relatively soft for milling a milled pattern (see milled pattern 45 FIG. 2) and further work-hardens over time to produce a hardened outer layer 49 (FIG. 3B) that is a wear resistant layer suitable for long life and multiple impressions in a die press.

Example 1

In an example, a counter-die of the present invention was tested for hardness at varying depths. The counter-die was formed from 201 stainless steel plate material and exhibited a hardness level of approximately 85-92 on the Rockwell Hardness B Scale, which is approximately 18-20 HRC, as received from the mill. The counter-die was also substantially flat or planar as received from the mill, which is a general property of a non-heat treated plate material. The counter-die was cut to specification for mounting to a die press and milled as necessary commensurate with a predetermined cutting pattern of an associated cutting die. The counter-die was run in a die press for approximately 4 million impressions with the associated cutting die and then removed for hardness testing. Results of the hardness testing are shown below in Table 2 as used in an impact hardness testing method at 500 gf (grams force). Results are shown in Knoop Hardness (KNH) units as well as on the Rockwell B and Rockwell C scales (HRB, HRC respectively).

TABLE 2

| 201 Stainless Steel Counter-die | | | |
|---|---|---|---|
| Depth in mm | Depth in Inches | Hardness KNH | Hardness on Rockwell Scale |
| 0.457 mm | 0.018" | 492 | 46 HRC |
| 0.635 mm | 0.025" | 405 | 40 HRC |
| 0.889 mm | 0.035" | 365 | 36 HRC |
| 1.1938 mm | 0.047" | 214 | 92 HRB (20 HRC) |

Thus, as shown in Table 2, the upper portion (or bearing surface) of the counter-die, at about 0.457 mm, is akin to the hardened outer layer of counter-die 42 indicated at reference numeral 49 in FIG. 3B. This hardened outer layer, as tested, shows a hardness level that is well with in the mid-range hardness on the Rockwell C Scale. As noted above, this is a suitable hardness for a long service life counter-die product. The greatest depth tested, at 1.1938 mm, is akin to the body portion of counter-die 42, indicated at reference numeral 43 in FIG. 3B. Thus, the body portion of the counter-die tested exhibits a hardness of 92 HRB which is comparably about 20 HRC. This is a nominal change from the starting hardness of the plate material as received from the mill. Thus, Example 2 demonstrates the counter-die of the present invention is configured to work-harden over time (with multiple impressions) to form a hardened outer layer that increases the service life of the counter-die. Therefore, hardened outer layer of counter-die 42 indicated at reference numeral 49 in FIG. 3B, has work-hardened from approximately 18-20 HRC (a soft plate material) to 46 HRC (a hard plate material). Thus, the hardened outer layer 49 of counter-die 42 has more than doubled in hardness as indicated by the Rockwell C Scale values noted above. The bearing surface of a counter-die of the present invention is configured to work-harden into a hardened outer layer having a hardness that is increased about 50% to about 200% as compared to the original hardness of the bearing surface, and more commonly exhibiting a hardness increase in the range of about 100% to about 150% after work-hardening. Thus, a counter-die of the present concept may have an initial hardness of about 18-20 HRC (soft) as received from the mill and then have a work-hardened bearing surface in a range of 27-54 HRC or 30-60 HRC (medium-hard to hard) when the hardness is increased about 50% to about 200%. Or, a counter-die of the present concept may have an initial hardness of about 18-20 HRC (soft) as received from the mill and then have a work-hardened bearing surface in a range of 36-45 HRC or 40-50 HRC (medium-hard to hard) when the hardness is increased about 100% to about 150%.

Figure 4:
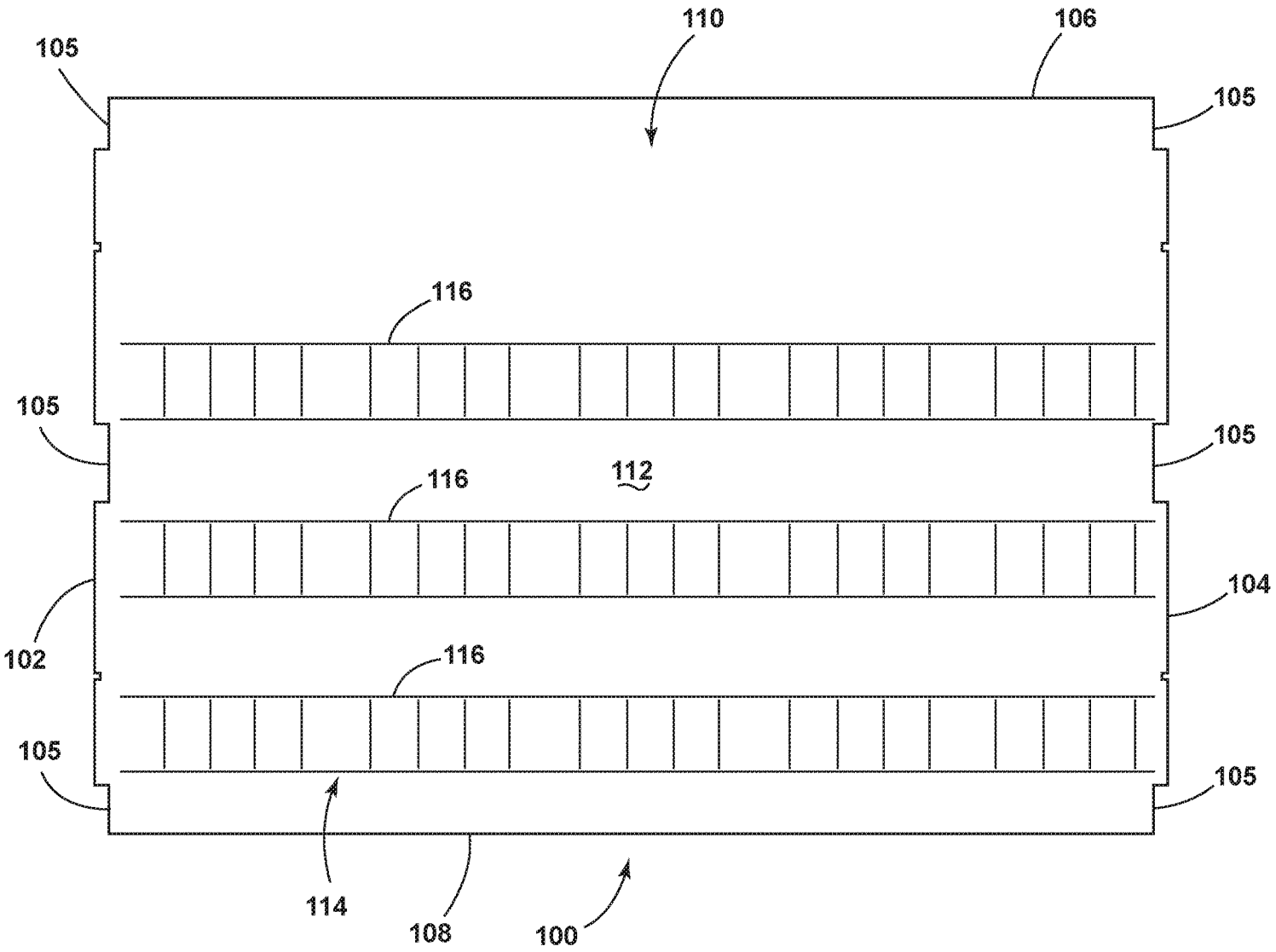
FIG. 4 is a perspective view of a counter-die according to another embodiment of the present invention.
Figure 5:
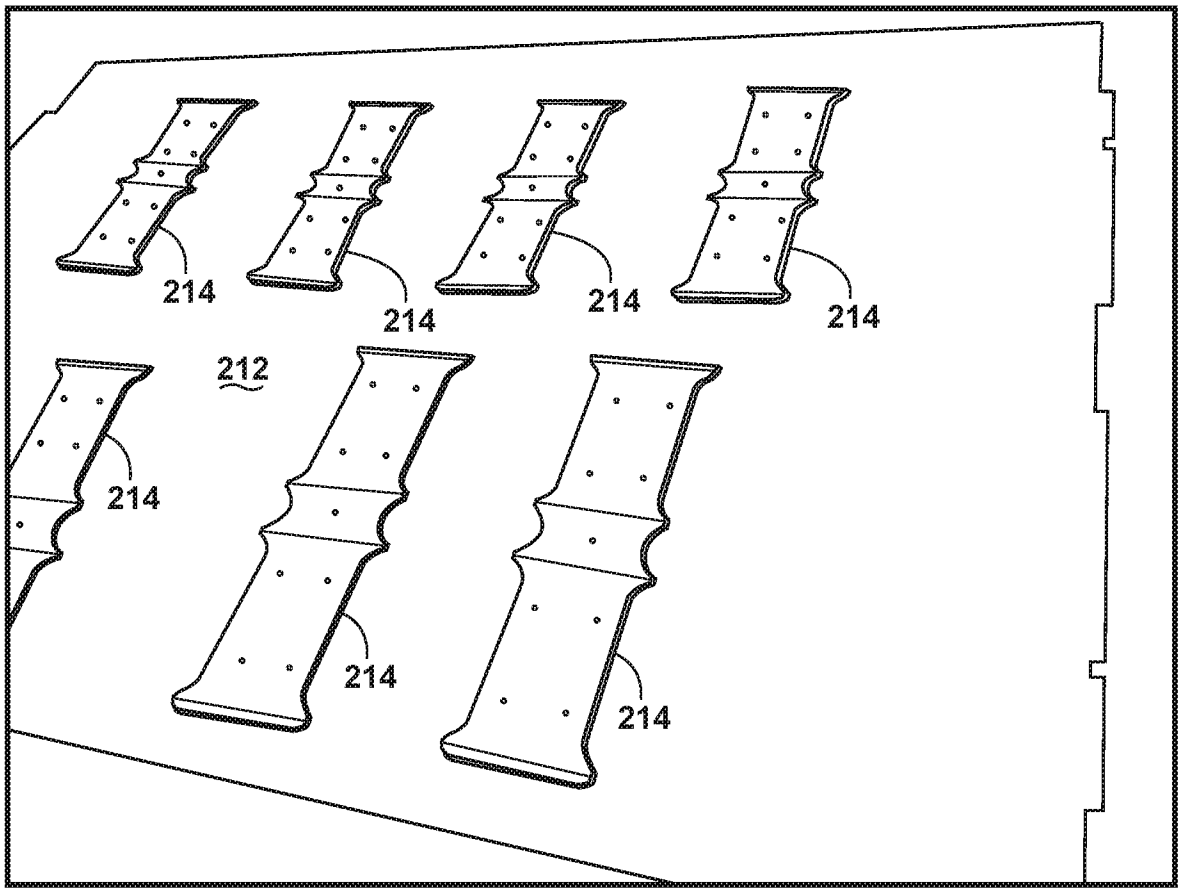
FIG. 5 is a perspective view of a counter-die according to yet another embodiment of the present invention.
Figure 6:
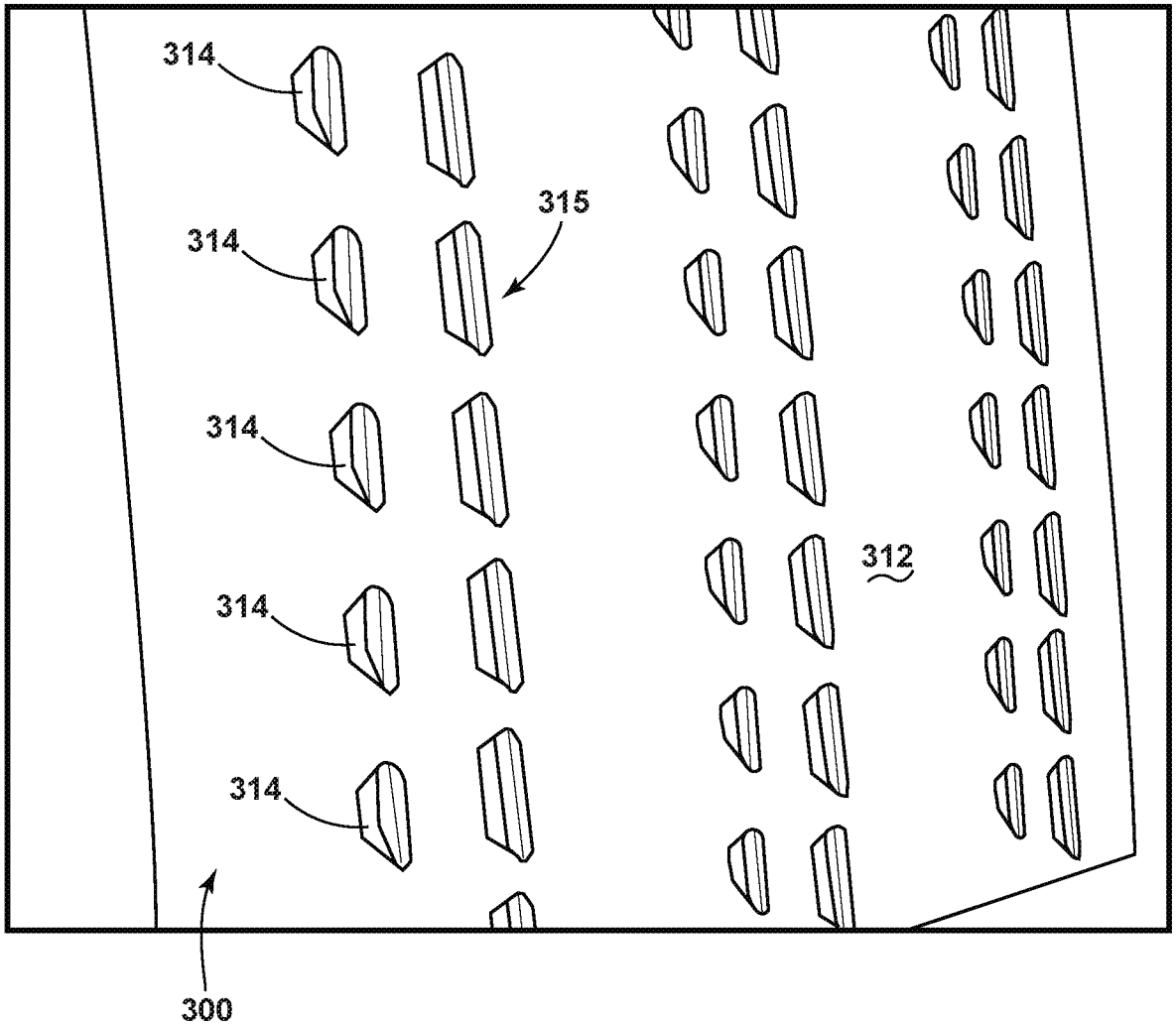
FIG. 6 is a perspective view of a counter-die according to yet another embodiment of the present invention.

Counter-dies have several uses in the die converting industry. With reference to FIGS. 4-6, a number of variations of counter-dies will now be described. With specific reference to FIG. 4, a counter-die 100 is shown having opposing side portions 102, 104 and top and bottom sides 106, 108. A generally planar body portion 110 is surrounded by the side portions and top and bottom sides 102, 104, 106 and 108, and includes a bearing surface 112, which is configured to work-harden to be a hardened outer layer, as described above. The side portions 102, 104 include locating features 105 for locating the counter-die 100 to a lower platen of a die press in use. Disposed on the bearing surface 112, a cutting pattern 114 has been milled or otherwise etched thereon for use with a corresponding cutting die. The cutting pattern 114 is comprised of a number of female channels 116 corresponding to a predetermined pattern. The female channels 116 are easily milled in the counter-die 100 which began as a "soft" plate that is configured to work-harden over time in use.

Referring now to FIG. 5, a counter-die 200 is shown having a bearing surface 212 to which a number of plastic counters 214 have been affixed. The plastic counters 214 are used with a corresponding creasing rule on a male die in a die press to crease a paperboard substrate in a die converting process. The plastic counter 214 are generally adhered to the bearing surface 212 of the counter-die 200. The plastic counters 214 may be directly adhered to a lower platen, such as lower platen 40 shown in FIG. 3A, but the platen must then be scraped to remove the plastic counters 214 when a dies press is reset for another job. This is a time consuming task. Thus, an inexpensive 201 stainless steel counter-die, such as counter-die 200, can be used as a transfer plate for selective use with a die press when a particular creasing job is desired. In use, the bearing surface 212 is configured to work-harden to be a hardened outer layer, after several impressions in a die converting process.

Referring now to FIG. 6, a counter-die 300 is shown having a bearing surface 312 to which a number of creasing channels 314 have been affixed. The creasing channels 314 are used with a corresponding creasing rule on a male die in a die press to crease a paperboard substrate in a die converting process. The creasing channels 314 define a creasing matrix 315 which can be easily setup and removed from a die press when the counter-die 300 is used as a transfer plate. In use, the bearing surface 312 of the counter-die 300 is configured to work-harden to be a hardened outer layer, much like hardened outer layer 49 shown in FIG. 3B, after several impressions in a die converting process.

The counter-dies 100, 200 and 300, shown in FIGS. 4-6, are substantially planar plates that are formed from a soft plate material, such as 201 stainless steel. The counter-dies 100, 200 and 300, shown in FIGS. 4-6 may be made by a method of making a counter-die which includes the steps of forming a plate from a soft plate material, such as 201 stainless steel, wherein the plate or counter-die 42 includes a bearing surface 44 (FIG. 3A). The next step may include milling a cutting pattern 45 (FIG. 2) into the bearing surface 44. The plate, such as counter-die 42 shown in FIG. 3A, may then be aligned with a corresponding male die 62 in a die press 60. The bearing surface 44 may then be work-hardened in a die converting process, wherein the corresponding male die 62 makes an impression on the plate 42, to form a counter-die 42 with a compacted and hardened outer layer 49 (FIG. 3B).

It will be understood by one having ordinary skill in the art that construction of the described invention and other components is not limited to any specific material. Other exemplary embodiments of the invention disclosed herein may be formed from a wide variety of materials, unless described otherwise herein.

The invention claimed is:

1. A die press comprising a cutting die and a counter-die opposite the cutting die, the counter-die comprising:

a metal plate having a monolithic body portion comprising:

a first material thickness having a first Rockwell Scale hardness value; and a work-hardened bearing surface comprising a second Rockwell Scale hardness value that is greater than the first Rockwell Scale hardness value, wherein the work-hardened bearing surface is defined on an exposed upper face of the body portion, and wherein the exposed upper face covers an entirety of the body portion; and a lower mounting surface disposed on an underside of the body portion and configured to be received on a lower platen of said die press, and wherein the work-hardened bearing surface is disposed on an opposite side of the body portion relative to the lower mounting surface, wherein the work-hardened bearing surface covers an entirety of the exposed upper face, and further wherein the work-hardened bearing surface is formed after repeated impressions realized on the counter-die by said cutting die in a die converting process, and wherein the metal plate includes creasing grooves milled therein and cutting lines.

2. The counter-die of claim 1, wherein the first Rockwell Scale hardness value is in a range from 18 to 20 on the Rockwell C Scale.

3. The counter-die of claim 2, wherein the second Rockwell Scale hardness value is in a range from 32 to 52 on the Rockwell C Scale.

4. The counter-die of claim 1, wherein the second Rockwell Scale hardness value is greater than 32 on the Rockwell C Scale.

5. The counter-die of claim 1, wherein the second Rockwell Scale hardness value is in a range from 36 to 52 on the Rockwell C Scale.

6. The counter-die of claim 1, wherein the second Rockwell Scale hardness value is 50% to 200% greater than the first Rockwell Scale hardness value.

7. The counter-die of claim 6, wherein the second Rockwell Scale hardness value is 100% to 150% greater than the first Rockwell Scale hardness value.

8. The counter-die of claim 7, wherein the first Rockwell Scale hardness value is 18 to 20 on the Rockwell C Scale.

9. The counter-die of claim 1, wherein the metal plate is comprised of 201 stainless steel.

10. The counter-die of claim 9, wherein the metal plate is a non-tempered stainless steel.

11. The counter-die of claim 10, wherein the metal plate is substantially planar and distortion free.

12. The counter-die of claim 1, wherein the metal plate further includes one or more recesses disposed transversely on one or more of the cutting lines.

13. A method of making a counter-die for use opposite a cutting die in a die press comprising the steps of:

forming a metal plate with a body portion and an upper bearing surface from a soft plate material, wherein the body portion has a first material thickness and a first Rockwell Scale hardness value;

milling creasing grooves and cutting lines into the metal plate;

registering the metal plate on a lower platen of a die press, wherein the metal plate includes a lower mounting surface disposed on an underside of the body portion that is configured to be received on the lower platen;

registering a corresponding cutting die on an upper platen of the die press; and work-hardening the upper bearing surface in a die converting process, wherein the cutting die makes repeated impressions on the metal plate, to form a counter-die having a monolithic body portion comprising the first material thickness having the first Rockwell Scale hardness value and a work-hardened bearing surface that has a second Rockwell Scale hardness value that is greater than the first Rockwell Scale hardness value of the body portion of the metal plate, and wherein the upper bearing surface defines an exposed upper face covering an entirety of the body portion, and wherein the work-hardened bearing surface is disposed on an opposite side of the body portion relative to the lower mounting surface and covers an entirety of the exposed upper face.

14. The method of claim 13, wherein the soft plate material includes a Rockwell Scale hardness value of 18 to 20 on a Rockwell C Scale.

15. The method of claim 14, wherein the work-hardened bearing surface includes a Rockwell Scale hardness value of 36 to 52 on a Rockwell C Scale.

16. The method of claim 15, wherein the step of work-hardening the bearing surface in a die converting process further includes:

reducing the first material thickness of the metal plate by 0.0127 mm to 0.0381 mm.

17. A counter-die configured for use with a cutting die in a die press, the counter-die comprising:

a metal plate having a monolithic body portion comprising:

a first material thickness having a first Rockwell C Scale hardness value in a range from 18-20; and a work-hardened bearing surface defined on an exposed upper face of the body portion, wherein the exposed upper face covers an entirety of the body portion and the work-hardened bearing surface covers an entirety of the exposed upper face, and wherein the work-hardened bearing surface is formed after repeated impressions realized on the counter-die by said cutting die in a die converting process, and further wherein the work-hardened bearing surface includes a second Rockwell C Scale hardness value that is 50% to 200% greater than the first Rockwell C Scale hardness value of the first material thickness of the body portion, and wherein the metal plate includes creasing grooves milled therein and cutting lines.

18. The counter-die of claim 17, wherein the second Rockwell C Scale hardness value is in a range from 32 to 52 on the Rockwell C Scale.

19. The counter-die of claim 17, wherein the metal plate is a non-tempered stainless steel.

20. The counter-die of claim 17, wherein the body portion has a thickness of less than about 2.1 mm.

* * * * *